US010066309B2

(12) United States Patent
Wright

(10) Patent No.: US 10,066,309 B2
(45) Date of Patent: Sep. 4, 2018

(54) METHOD AND APPARATUS FOR ELECTROCHEMICAL REDUCTION OF A SOLID FEEDSTOCK

(75) Inventor: Allen Richard Wright, Gunnerton (GB)

(73) Assignee: METALYSIS LIMITED (GB)

( * ) Notice: Subject to any disclaimer, the term of this patent is extended or adjusted under 35 U.S.C. 154(b) by 789 days.

(21) Appl. No.: 13/983,123

(22) PCT Filed: Feb. 2, 2012

(86) PCT No.: PCT/GB2012/050219
§ 371 (c)(1),
(2), (4) Date: Oct. 4, 2013

(87) PCT Pub. No.: WO2012/104640
PCT Pub. Date: Aug. 9, 2012

(65) Prior Publication Data

US 2014/0021058 A1 Jan. 23, 2014

(30) Foreign Application Priority Data

Feb. 4, 2011 (GB) ..... 1102023.7

(51) Int. Cl.
*C25C 7/00* (2006.01)

(52) U.S. Cl.
CPC ..... *C25C 7/007* (2013.01); *C25C 7/005* (2013.01)

(58) Field of Classification Search
CPC ..... C25C 7/005; C25C 7/007
See application file for complete search history.

(56) References Cited

U.S. PATENT DOCUMENTS

| | | | | |
|---|---|---|---|---|
| 3,446,674 | A | 5/1969 | Giner | |
| 4,097,354 | A * | 6/1978 | Ginatta | C25B 9/00 204/206 |
| 6,540,902 | B1 * | 4/2003 | Redey | C25C 3/00 205/354 |
| 2005/0050989 | A1 | 3/2005 | Osborn et al. | |
| 2005/0139474 | A1 * | 6/2005 | Lewin | C25C 3/34 205/43 |
| 2006/0191799 | A1 | 8/2006 | Strezov | |
| 2006/0226027 | A1 | 10/2006 | Shook et al. | |

(Continued)

FOREIGN PATENT DOCUMENTS

| | | |
|---|---|---|
| BE | 683762 | 12/1966 |
| CN | 101440503 | 5/2009 |
| GB | 1 361 709 | 7/1974 |

(Continued)

*Primary Examiner* — Luan V Van
*Assistant Examiner* — Salil Jain
(74) *Attorney, Agent, or Firm* — Saliwanchik, Lloyd & Eisenschenk

(57) ABSTRACT

The method, apparatus and product relate to the electrochemical reduction of a solid feedstock (20) to produce a product. A container (2) is filled with a fused salt (6), and one or more anodes (14) contact the fused salt. A cathode (18) is loaded with feedstock and engages with a transport apparatus (22, 36, 40) which locates and moves the cathode past the anodes(s), while the cathode and the feedstock contact the fused salt. As the cathode moves past the anodes(s), a voltage applied between the cathode and the anode(s) electrochemically reduces the solid feedstock to form the product.

22 Claims, 10 Drawing Sheets

(56) References Cited

U.S. PATENT DOCUMENTS

| | | | | |
|---|---|---|---|---|
| 2007/0193877 | A1* | 8/2007 | Rigby | C25C 5/04<br>204/243.1 |
| 2008/0047845 | A1* | 2/2008 | Rigby | C22B 4/08<br>205/771 |

FOREIGN PATENT DOCUMENTS

| | | |
|---|---|---|
| WO | WO 2010/052714 | 5/2010 |
| WO | WO 2010/131000 | 11/2010 |
| WO | WO 2010/146369 | 12/2010 |

* cited by examiner

METHOD AND APPARATUS FOR ELECTROCHEMICAL REDUCTION OF A SOLID FEEDSTOCK

CROSS-REFERENCE TO RELATED APPLICATION

This application is the National Stage of International Application Number PCT/GB2012/050219, filed Feb. 2, 2012, which is hereby incorporated by reference herein in its entirety, including any figures, tables, nucleic acid sequences, amino acid sequences, or drawings.

The invention relates to a method and an apparatus for electrolysis, and to an electrolysis product, and more particularly to a method and an apparatus for the continuous electrolysis of a solid feedstock to produce a solid product, and to the solid product.

Electro-reduction or electro-decomposition is a method for processing a solid feedstock comprising a metal or a semi-metal and another substance, to remove some or all of the substance and produce a solid product. (In this document, for brevity, the term metal will be used to encompass metals and semi-metals in the context of the feedstock and the product.) The feedstock preferably comprises a compound between the metal and the substance, but may be in another form such as a solid solution of the substance in the metal. The process may also be termed electro-deoxidation, particularly where the substance to be removed from the feedstock is oxygen, for example if the feedstock is a metal oxide. The feedstock may comprise two or more metals, for example in the form of a mixture of metals or metal compounds, and the product may then comprise an alloy or intermetallic compound of the two or more metals.

In electro-reduction, as described in prior art documents such as WO 99/64638, WO 02/066711, WO 03/002785, WO 03/016594 and WO 03/076690, the feedstock is contacted with a fused-salt melt and is cathodically connected to a power supply. An anode is also contacted with the melt and connected to the power supply. As described in WO 99/64638, for example, on application of the cathodic potential to the feedstock, the substance dissolves in the melt and is transported through the melt to the anode. Other prior art, such as WO 03/076690, describes an electro-reduction mechanism in which a reactive metal such as Ca is electrolytically generated from the melt at the cathode and chemically reduces the feedstock, in a form of calciothermic reduction. For the sake of generality, in this document the term electro-reduction will be used to encompass any such mechanism for electrolytically reducing a solid feedstock. Most prior art descriptions of electro-reduction involve the electro-reduction of solid titanium oxide or other metal oxides in a Ca-based melt containing a mixture of calcium chloride and calcium oxide, to remove oxygen from the metal oxide and so produce the solid metal.

Most of the prior art publications of electro-reduction processes have described batch processes, but for a commercial process manufacturing a metal, alloy or intermetallic product in bulk it may be desirable to operate a continuous process rather than a batch process. Attempts have been made to develop such a process, as described in WO 2004/053201, WO 2004/113593, WO 2005/031041 and WO 2005/038092.

In WO 2004/053201 a feedstock in the form of pellets or a powder was poured into a cell containing a fused salt, either onto a cathode in the form of a horizontal rotating plate immersed in the salt, or into one end of a rotating Archimedean screw, or auger, immersed in the melt. The rotating plate or screw moved the feedstock through the fused salt during electro-reduction to produce a reduced product. The product was then described as being continuously or semi-continuously removed from the melt, but no method for doing this was described. In WO 2004/113593, WO 2005/031041 and WO 2005/038092 a feedstock in the form of pellets or a powder was again poured into a cell containing a fused salt. In this case, the poured feedstock was collected on an oscillating or vibrating cathode plate immersed in the fused salt. The cathode plate was oriented horizontally or downwardly inclined, and the feedstock was caused to move across the cathode plate by the oscillation or vibration of the cathode plate. The feedstock was electrolytically reduced as it moved across the cathode plate until the reduced product fell off the end of the cathode plate and into a sump at the bottom of the fused-salt container, where an upwardly-inclined auger was arranged to collect pellets of product from a lower end of the sump and to transport the pellets away from the cell.

These proposed processes suffer a number of practical problems, such as the requirement for complex mechanical structures being immersed in the high-temperature, chemically-aggressive and corrosive environment of the fused-salt melt, and have not been successfully implemented.

The invention aims to solve the problem of providing an effective and commercial method and apparatus for continuous electro-reduction of a solid-phase feedstock.

SUMMARY OF INVENTION

The invention provides an apparatus, a method and a product as defined in the appended independent claims, to which reference should now be made. Preferred or advantageous features of the invention are set out in dependent subclaims.

A first aspect of the invention may thus provide an apparatus for electrochemical reduction of a solid feedstock. The apparatus comprises a container for a fused salt, the container preferably having a base and a peripheral wall extending upwardly from the base. An anode assembly comprises one or more anodes and during use of the apparatus when the container contains the fused salt, the anode or anodes contact the fused salt, for example being at least partially immersed in the fused salt. A cathode is provided which is loadable with feedstock, for example having an upper surface which is substantially horizontal during use of the apparatus, such that solid feedstock can be loaded onto the upper surface. The cathode is locatable in the container by a cathode transport apparatus such that, during use, the cathode and the feedstock contact the fused salt and can be moved past the anode assembly, for example being moved below the anode assembly, or between the anode assembly and the base of the container. The cathode, or a component of a cathode assembly comprising the cathode, may contact the base or a wall of the container, either temporarily or continuously, as it moves past the anode assembly.

A continuous electro-reduction process may then advantageously be implemented by moving a plurality of similar cathodes past the anode assembly, one after the other. For clarity, however, the following description will initially consider the handling of one such cathode.

As the cathode and the feedstock pass the anode(s) of the anode assembly, a voltage applied between the anode(s) and the cathode by a power supply reduces the solid feedstock to a solid product, or a reduced feedstock. The specific mechanism of the electrolytic reduction is not a feature of the invention and may vary depending on the operating conditions in the cell. As noted above, the prior art describes more than one potential mechanism for the electrolytic reduction of a solid feedstock and the inventor does not consider the present invention to be limited to any one of these potential mechanisms. During operation of a cell embodying the present invention it is even possible that more than one such mechanism may operate, either simultaneously or at different stages of reduction of the feedstock. The term electro-reduction is therefore used in this document to encompass any suitable electrolytic mechanism or mechanisms.

Advantageously, the cathode is loaded with feedstock, for example at a feedstock loading station, before immersion in the fused salt. The cathode transport apparatus may then lower the cathode, loaded with the feedstock, into the container at a loading position before moving the cathode past the anode assembly for electro-reduction of the feedstock to form the product. The cathode transport apparatus may then raise the cathode and the solid product carried by the cathode out of the container at an unloading position. In a preferred embodiment, the cathode may be raised out of the fused salt into an inert atmosphere at the unloading position in order to prevent reaction between the product and air at the high temperature at which the product is removed from the fused salt. The inert atmosphere may be, for example, argon or nitrogen, preferably contained in a vessel or shroud. The product may be held in the inert atmosphere until it has cooled sufficiently to be washed, to remove any of the salt in contact with the product, and exposed to air.

Preferably the unloading position is spaced from the loading position. For example the anode assembly may be positioned between the loading position and the unloading position. In other words the loading position may be at a first side, or end, of the anode assembly and the unloading position may be at a second side, or end, of the anode assembly, spaced from or opposite to the first side or end. In a preferred embodiment, the anode assembly may be positioned above a central portion of the container, and the loading position and the unloading position may be at opposite ends of the container such that the cathode can be lowered into the container at a first end of the container, moved past the anode assembly, and raised from the container at a second end of the container, opposite to the first end.

The cathode may advantageously be in the form of a tray for carrying feedstock, having an upper surface which is substantially horizontal in use, and optionally comprising a wall or upwardly-extending flange at its edge for retaining the feedstock and (after electro-reduction) the product in position on the cathode.

The feedstock is advantageously in the form of pellets or particles which can be loaded onto or into the cathode simply by pouring, so that the feedstock is randomly arranged, or heaped, on or in the cathode. The pellets or particles of the feedstock are preferably porous, allowing access of the fused salt into pores in the feedstock so as to increase the rate of electro-reduction. The pellets or particles may be formed from the feedstock material in powder form, suitably agglomerated or moulded to form the pellets or particles, and optionally sintered.

In a preferred implementation of the invention the feedstock is cathodically connected as it is reduced to form the product. In this case, the feedstock and/or the product may be considered as forming part of the cathode in the electrolytic cell during electro-reduction. In this document, however, the term cathode will be used where appropriate to refer to the conductive element of the cathode structure on or in which the feedstock is loaded for electro-reduction, such as the electrically-conductive tray in the preferred embodiment described above.

The cathode, contacting the feedstock, is preferably of a non-magnetic material, such as stainless steel or titanium, in order to reduce the risk of magnetic fields, generated by current flows during electro-reduction, affecting the movement of the cathode and the transport apparatus. In addition, the material of the cathode should preferably be inert in the presence of the feedstock and/or the product, while immersed in the fused salt.

The anode(s) of the anode assembly contacting the fused salt may be of an inert material or may be of a consumable material. The anode(s) may be of carbon. The position of the anode or each anode may be adjustable to control the spacing between the anode or each anode and the cathode as the cathode passes the anode(s). For example, in an embodiment in which the cathode passes below the anode assembly, the anode assembly may comprise an array of horizontally-spaced anodes, each of which is preferably independently movable in a vertical direction. This may be important if a consumable anode material is used in order to adjust the spacing of each anode from the cathode as the anodes are consumed during electro-reduction.

Except for the facility to adjust the spacing between the anode(s) and the cathode, the anode(s) are preferably held stationary as the cathode moves past the anode(s).

In a preferred embodiment, the cathode transport apparatus may comprise one or more cathode supports which extend upwardly from the cathode such that, when the cathode is immersed in the fused salt, an upper end of the cathode support or each cathode support extends above a surface of the fused salt to interact with other parts of the cathode transport apparatus so as to enable the positioning and movement of the cathode. In this way many of the parts of the cathode transport apparatus, and importantly all such parts which move relative to one another, may advantageously be located outside the fused salt.

The container for the fused salt may comprise a base and a peripheral wall, and an opening may be defined between the peripheral wall and the anode assembly. One or more cathode supports may then extend upwardly through the opening when the cathode is in position in the fused salt during electro-reduction. In a preferred embodiment, the container may be rectangular in plan, having two parallel side walls, with an opening defined between each side wall and the anode assembly, for example on opposite sides of the anode assembly. In that case, a cathode may advantageously be supported by two cathode supports, each extending through a respective one of the openings.

A lower end of each cathode support may engage with or support the cathode, such as a cathode in the form of a tray as described above, or a cathode of any other form suitable for holding or carrying feedstock. During electro-reduction, a lower end of each cathode support may engage with the cathode, the cathode support may extend upwardly out of the fused salt and an upper end of the cathode support may be positioned above the fused salt and/or above the peripheral wall of the container. The upper end of the cathode support may then engage with a drive apparatus of the cathode transport apparatus so as to move the cathode support during electro-reduction, such that the cathode moves past the anode(s). The drive apparatus may also engage with the cathode support(s) so as to raise and lower the cathode during loading into and removal from the fused salt.

At least one cathode support engaged with the cathode may be electrically conductive and in electrical contact with the cathode, to conduct electricity to the cathode. The cathode support may be electrically insulated from the fused salt, to reduce current leakage into the fused salt. The cathode support may, for example, comprise a conductive metal core shielded by a ceramic sheath In a preferred embodiment, the drive apparatus may comprise a rail extending alongside the opening or each opening between the wall of the container and the anode assembly. The cathode support or each cathode support may engage with a respective rail to locate the cathode in position. At least one such rail may be electrically conductive and in electrical contact with an electrically-conductive cathode support, for example by means of a sliding contact. A cathodic potential may then be applied to the cathode by applying a voltage to the electrically-conductive rail.

The cathode and the cathode transport apparatus advantageously comprise no moving parts which are exposed to the fused salt. The cathode may be removably engageable with the cathode transport apparatus, for example being removably engageable one or more cathode supports of the cathode transport apparatus, but when the cathode is engaged with the cathode transport apparatus it is preferred that no components of the cathode, or of the portion of the cathode transport apparatus which is exposed to or immersed in the fused salt, should move relative to one another. This may advantageously reduce or avoid problems of corrosion or wear in the cathode and the portions of the cathode transport apparatus immersed in the fused salt.

To carry out the electro-reduction process it is necessary to maintain the temperature of the fused salt at a predetermined temperature, typically of between 850 C and 1000 C, or preferably between 900 C and 970 C. In order to reduce heat losses from the fused salt it may be desirable to thermally insulate the container of fused salt. This may include providing thermal insulation within any openings between the wall of the container and the anode assembly. As described above, each cathode support may pass through such an opening. To provide thermal insulation, one or more of the cathode supports may comprise a thermally-insulating block for at least partially filling a portion of the corresponding opening in the region of the cathode support. The thermally-insulating block or each thermally-insulating block may advantageously be spaced from the fused salt during electro-reduction to avoid corrosion of the block or contamination of the salt. A flexible insulating material may be desirable, in order to accommodate any variations in the width of the opening through which the cathode support extends.

For additional thermal insulation, and to reduce any problems of corrosion of the side walls of the container, it may be desirable to operate the electro-reduction apparatus such that a solid frozen layer of the fused salt is maintained on a side wall of the container. The cathode support or each cathode support may then advantageously be shaped so as to be spaced from any solidified layer of the fused salt on the side wall.

In an alternative embodiment, an insulating material in powder or particulate form may be placed as a layer on top of the fused salt, for example a ceramic powder of density lower than the density of the fused salt.

The drive apparatus of the cathode transport apparatus may comprise a mechanical system for moving the cathode support or each cathode support such that the cathode moves past the anode(s) during electro-reduction. The drive apparatus may thus comprise a conveyer or chain-drive system, for example, for engaging with and moving the cathode support or each cathode support. The drive apparatus may be controllable to vary the speed of movement of the cathode past the anode, and/or temporarily to stop and/or reverse the motion of the cathode. Such movement of the cathode may be used, for example, to mix or agitate the fused salt.

As noted above, the cathode and any portions of the cathode transport apparatus exposed to the fused salt preferably comprise no moving parts. Thus, the mechanical system for moving the cathode support or each cathode support, as described above, is preferably not in contact with, or is spaced from, the fused salt.

If required, the cathode may comprise one or more downwardly-extending flanges or scoops, preferably arranged so as to be in contact with or in close proximity to the base of the container during electro-decomposition. Movement of the cathode may then advantageously disturb or remove contaminants from the container, and in particular contaminants which are of higher density than the fused salt and so collect near or on the base of the container. If, for example, the cathode moves from one end of the container to another during electro-reduction, the provision of a flange or scoop on the cathode may advantageously tend to move contaminants towards the cathode unloading position, for convenient removal of the contaminants from the container. For example the contaminants may then be removed by draining through a tap or closable outlet at or near the base of the container, in the region of the unloading position.

A preferred aspect of the invention provides an apparatus and a method for the continuous electro-reduction of a solid phase feedstock. Advantageously, therefore, the cathode is one of a plurality of cathodes which can be successively loaded into the container, carrying solid feedstock, moved past the anode assembly for electro-reduction, and then raised out of the container carrying reduced feedstock, or product. For example, two or more of the plurality of cathodes can be moved past the anode assembly at the same time. Each cathode may be supported by or engaged with a respective cathode support, or plurality of cathode supports. Each of the cathode supports may engage with the transport means to move the cathodes, one behind the other, past the anode assembly.

In a preferred embodiment, the invention operates using a constant-current, or current-controlled, power supply, in the same way as a Hall-Hèroult cell for aluminium production, for example. It may alternatively be possible to operate the invention using a constant-potential, or potential-controlled, power supply but it is envisaged that a constant-current power supply is preferable where a plurality of cathodes moves past the anode assembly at the same time. Advantageously, where a production facility comprises a plurality of similar cells, the same constant-current power supply may then be applied to two or more cells, or even to all of the cells.

Depending on the arrangements for supplying current to the cathodes, either the same potential or different potentials may be applied to each cathode immersed in the fused salt at any time. For example, if each cathode is connected to the power supply through a sliding contact to a common cathode-support rail as described above, the same potential will be supplied to each cathode. Alternatively, each cathode could be individually coupled to a power supply, for the application of different potentials or currents, or varying potentials or currents, to each cathode.

Further aspects of the invention may advantageously provide methods of operating an electro-reduction apparatus as described above, and a cathode for the apparatus, as well as electro-reduced product formed using the apparatus.

Embodiments of the invention may be used for electro-reduction of a wide range of feedstocks, including substantially any metal oxide.

A further aspect of the invention provides an approach for arranging a plant for the commercial fabrication of an electro-reduction product. In a preferred embodiment, this approach may allow the conversion of existing electrolytic production facilities, and in particular aluminium production facilities such as plants using the Hall-Hèroult process, to adapt them for the electro-reduction of solid phase feedstocks.

In such an existing production facility, the containers for fused salt and the anode assemblies may be of significant size. Such a container typically has a length greater than its width and, after conversion for electro-reduction of solid feedstocks, the direction of motion of the cathode may advantageously be parallel to the length of the container, in order to provide a suitable duration for the electro-reduction process. If the cathode is to pass below the anode(s), as in the preferred embodiments described above, the anode(s) must then be suspended, preferably above a central portion of the container. Support can conveniently be provided by means of a load-bearing beam extending along the length of the container, above the central axis of the container, supported by an A-frame at each end of the container. The anodes in conventional Hall-Hèroult cells are typically supported in this way.

In a Hall-Hèroult cell, the anodes typically cover substantially the entire area of the surface of the fused salt. The containers may then be converted to operate the method for electro-reduction of solid feedstock by removing individual anodes, or portions of the anode assembly in order to provide a loading position and an unloading position, preferably at opposite ends of the container.

In such an apparatus, the cathode carrying feedstock and/or product may advantageously be loaded into the container and/or unloaded out of the container over a side wall of the container rather than over an end wall of the container, in order to avoid the A-frames.

In more general terms, the cathode may advantageously be loaded into the container and/or removed from the container in a direction perpendicular to a direction of motion of the cathode during electro-reduction.

In an aluminium production plant, a pot-room typically contains a large number of individual electrolysis containers, which may be arranged end-to-end or side-by-side. Where containers are arranged end-to-end, access to the sides of the containers is possible for loading and unloading cathodes (after conversion of the containers by removal of anodes to provide loading and unloading positions).

Where aluminium-production containers are arranged side-by-side, access to the sides of the containers may not be available for loading and unloading cathodes. In that case, in a further aspect of the invention, where a pre-existing aluminium production apparatus comprises three or more containers arranged side-by-side, every third container may be removed when converting the plant for the electro-reduction of solid feedstock. This leaves pairs of containers side-by-side and allows access to the side of each remaining container for loading and unloading cathodes.

The methods and apparatus of the various aspects of the invention described above are particularly suitable for the production of metal by the reduction of a solid feedstock comprising a solid metal oxide. Pure metals may be formed by reducing a pure metal oxide and alloys and intermetallics may be formed by reducing feedstocks comprising mixed metal oxides or mixtures of pure metal oxides.

Some reduction processes may only operate when the molten salt or electrolyte used in the process comprises a metallic species (a reactive metal) which is more reactive than a metal species in the feedstock. For example, if the feedstock comprises a metal oxide, the reduction process may only operate if the salt comprises a metallic species (a reactive metal) that forms a more stable oxide than the oxide being reduced. Such information is readily available in the form of thermodynamic data, specifically Gibbs free energy data, and may be conveniently determined from a standard Ellingham diagram or predominance diagram or Gibbs free energy diagram. Thermodynamic data on oxide and compound stability and Ellingham diagrams are available to, and understood by, electrochemists and extractive metallurgists (the skilled person in this case would be well aware of such data and information).

Thus, a preferred electrolyte for a reduction process may comprise a calcium salt. Calcium forms a more stable oxide than most other metals and may therefore act to facilitate reduction of any metal oxide that is less stable than calcium oxide. In other cases, salts containing other reactive metals may be used. For example, a reduction process according to any aspect of the invention described herein may be performed using a salt comprising lithium, sodium, potassium, rubidium, caesium, magnesium, calcium, strontium, barium, or yttrium. Chlorides or other salts may be used, including mixture of chlorides or other salts.

By selecting an appropriate electrolyte, almost any metal oxide or compound may be capable of reduction using the methods and apparatuses described herein. In particular, feedstocks comprising beryllium, boron, magnesium, aluminium, silicon, scandium, titanium, vanadium, chromium, manganese, iron, cobalt, nickel, copper, zinc, germanium, yttrium, zirconium, niobium, molybdenum, hafnium, tantalum, tungsten, and the lanthanides including lanthanum, cerium, praseodymium, neodymium, samarium, and the actinides including actinium, thorium, protactinium, uranium, neptunium and plutonium, including oxides and compounds of these metals, may be reduced, preferably using a molten salt comprising calcium chloride.

The skilled person would be capable of selecting an appropriate electrolyte in which to reduce a particular feedstock comprising a particular metal oxide or compound, and in the majority of cases an electrolyte comprising calcium chloride will be suitable.

SPECIFIC EMBODIMENTS AND BEST MODE OF THE INVENTION

Specific embodiments of the invention will now be described by way of example, with reference to the accompanying drawings, in which.

Figure 1:
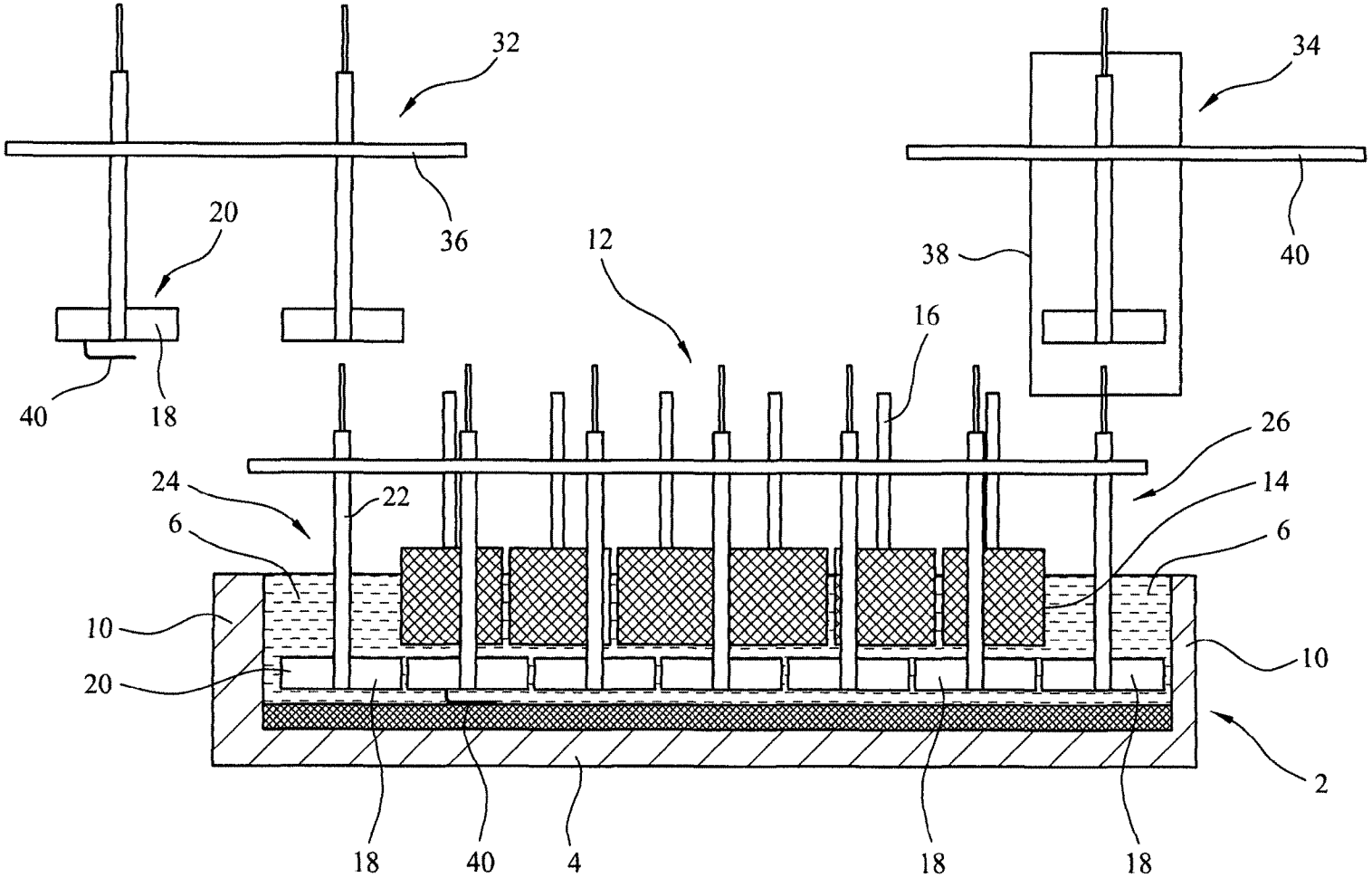
FIG. 1 is a schematic side view of an electro-reduction apparatus according to a first embodiment of the invention, with a side wall of the fused-salt container removed to show the structure inside the container.
Figure 2:
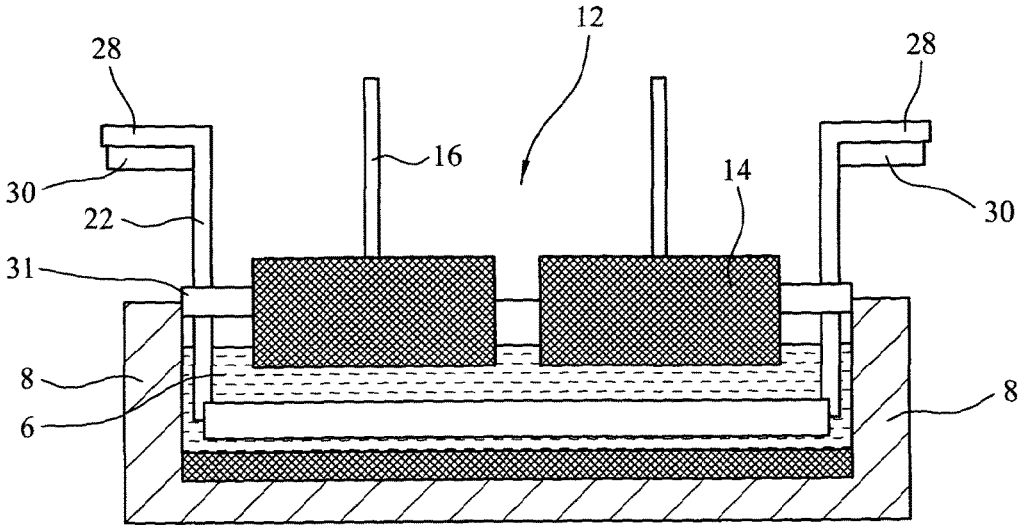
FIG. 2 is a transverse section through the apparatus of FIG. 1.
Figure 5:
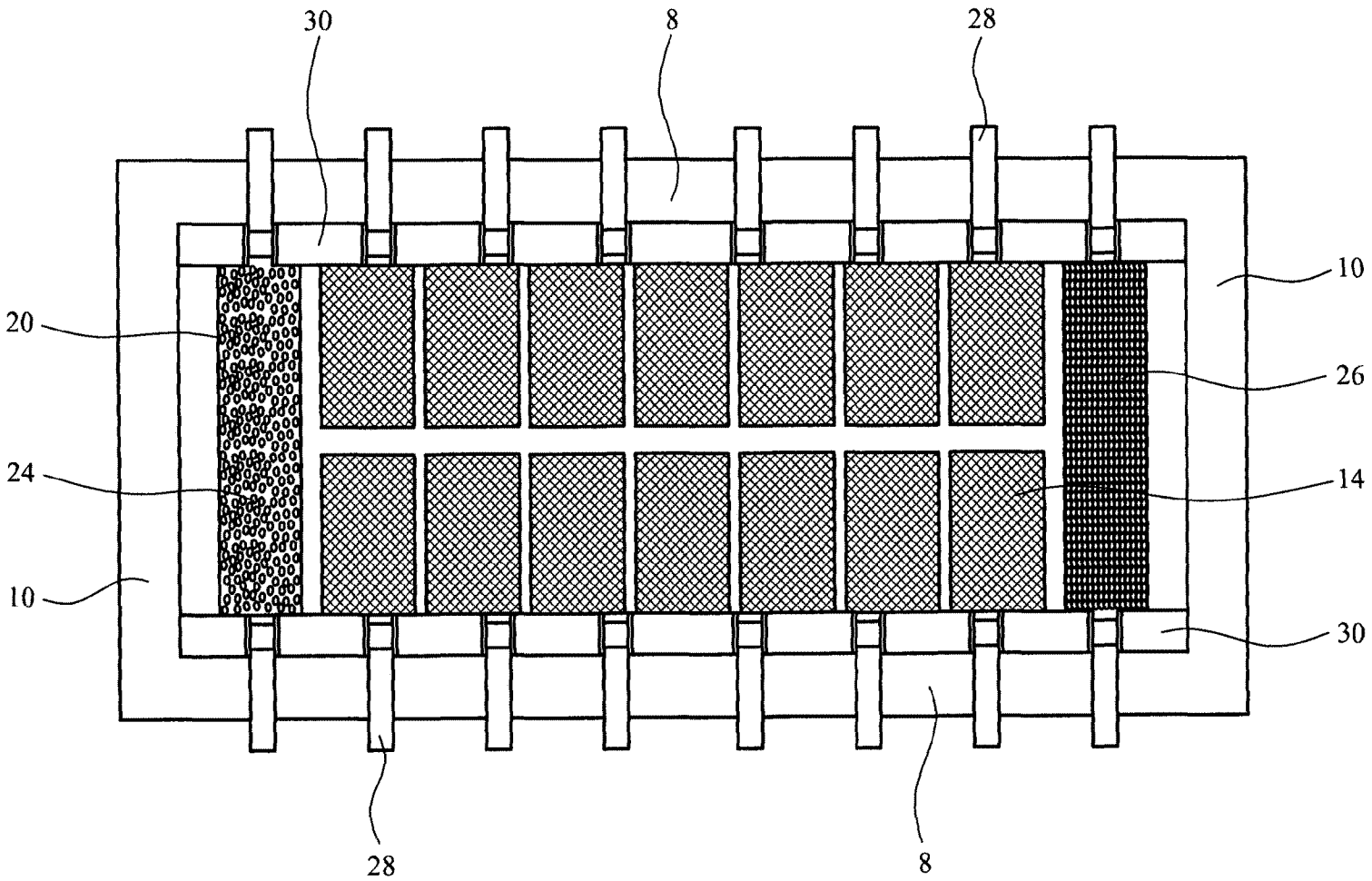
FIG. 5 is a schematic plan view of the electro-reduction apparatus of the first embodiment.

FIGS. 1 and 2 show longitudinal and transverse sections of an electro-reduction apparatus according to a first embodiment of the invention. FIG. 5 shows a plan view of the apparatus. The apparatus comprises a container 2 comprising a base 4 and a peripheral wall extending upwardly from the base for containing a fused salt 6. The container is rectangular in plan, the peripheral wall comprising two parallel side walls 8 and two parallel ends walls 10. The length of the cell between the end walls is greater than its width between the side walls.

An anode assembly 12 comprising an array of rectangular carbon anodes 14 is suspended from a beam (not shown in FIGS. 1 and 2) such that a lower end of each carbon anode is immersed in and contacts the fused salt. Current flows from the anodes through anode conductors 16.

Cathodes 18 in the form of electrically-conductive trays loadable with feedstock 20 are supported by cathode supports 22, which hold the cathodes in a horizontal orientation and extend upwardly from each end of the cathode. The trays are of stainless steel and have a peripheral lip, or upstanding flange or wall, to retain a layer of the feedstock on the cathode. The trays are perforated to allow the fused salt to flow through the trays during electro-reduction. The feedstock is in the form of porous pellets or particles formed by agglomeration or moulding of the feedstock in powder form, followed by sintering to increase the strength of the pellets or particles.

The apparatus comprises a plurality of cathodes which can be loaded into the fused salt for electro-reduction one after the other at a loading station 24 at one end of the container. During electro-reduction the cathodes move in a horizontal direction past the stationary anodes, between the anodes and the base of the container, to an unloading station 26 at the other end of the container.

Each cathode is generally rectangular in plan, and its longer dimension extends across the width of the container. A cathode support 22 at each end of the cathode extends upwardly, out of the fused salt and through an opening defined between a side wall 8 of the container and the anode assembly 12. An upper end 28 of each cathode support is cranked outwardly, away from the anodes, and rests on a rail 30 which is fixed in position above a side wall of the container. The length of the cathode support is such that when the upper end of the cathode support rests on the fixed rail, the cathode is suitably positioned for electro-reduction below the anodes.

Each fixed rail extends alongside or parallel to a side wall 8 of the container. As in the first embodiment illustrated in FIGS. 1 and 2, the rail may be held by a support structure (not shown) above the container side wall. Alternatively, as shown in the embodiment of FIG. 4, the rail may be secured to an upper edge of the side wall (the same numbering is used for similar components in the various embodiments described herein, where appropriate).

Figure 3:
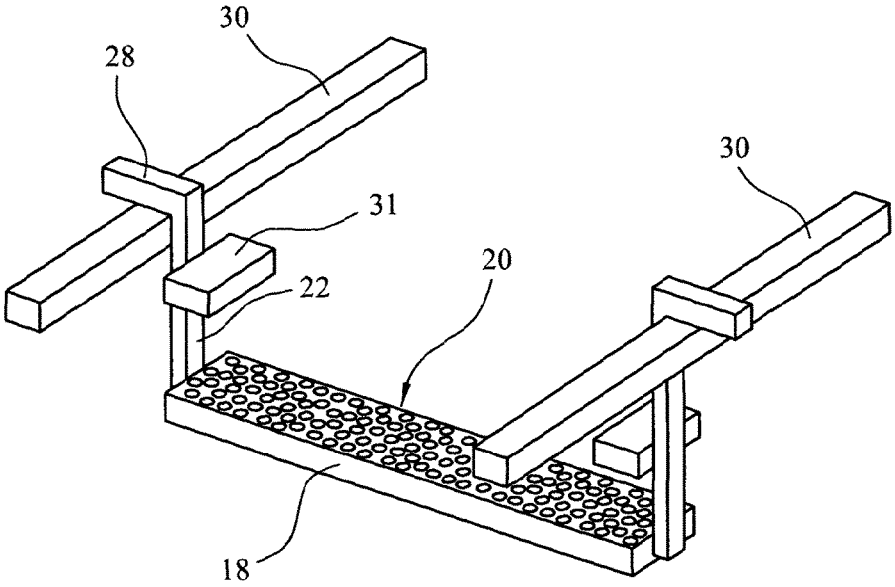
FIG. 3 is a three-quarter view of a loaded cathode and two cathode supports of the embodiment of FIGS. 1 and 2.
Figure 4:
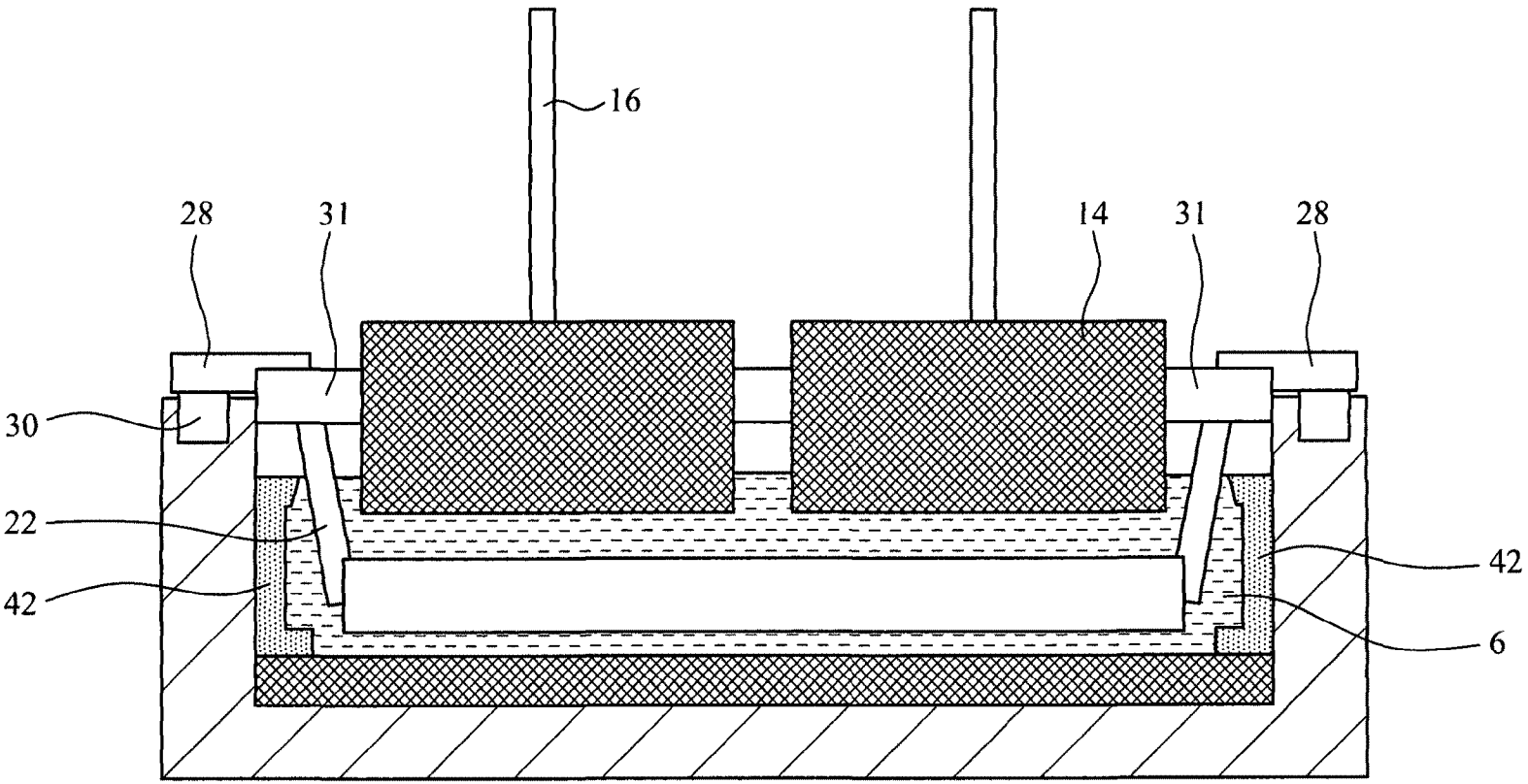
FIG. 4 is a transverse section of an apparatus according to a second embodiment of the invention.

As shown in FIGS. 2, 3 and 4 (but omitted from FIG. 1), each cathode support comprises a block 31 of a ceramic heat insulator (for example alumina) positioned so as to fill at least part of the opening defined between the side wall 8 of the container and the anodes 14 when the cathode is in position for electro-reduction beneath the anodes. The size of each heat-insulating block is determined such that the insulation is substantially continuous along the opening when a row of cathodes is in position beneath the anodes during electro-reduction. The length of each block is therefore equal to or less than the desired spacing of the cathodes during electro-reduction.

FIG. 1 shows a schematic illustration of a cathode loading apparatus 32 and an cathode unloading apparatus 34. At the loading apparatus, cathodes filled with feedstock are engaged with cathode supports and suspended from a pair of loading rails 34. Each cathode is then lowered into the fused salt at the loading position 24 until the upper ends 28 of the cathode supports 22 rest on the cathode-support rails 30 of the electro-reduction apparatus.

At the other end of the container, the unloading apparatus 34 comprises an unloading vessel or shroud 38, filled with an inert gas such as argon. At the unloading position 26, the cathode supports of a cathode can engage with a pair of unloading rails 40 of the unloading apparatus, which raise the cathode, now filled with reduced feedstock, into the shroud vessel 38. It may be desirable to unload the reduced feedstock into an inert atmosphere at this stage to prevent undesired re-oxidation of the electro-reduction product in air. The feedstock may then be cooled in the inert atmosphere and washed to remove any salt attached to the product.

The anode assembly 12 is positioned between the loading position and the unloading position, and electro-reduction of the feedstock occurs as the cathodes are moved from the loading position to the unloading position, beneath the anodes. During this process, the cathodes are cathodically connected to a power source (not shown). This is achieved in the embodiment by making the cathode support rail an electrical conductor, and coupling the conductive rail to the cathode voltage of the power supply. Each cathode support is also electrically conductive and its upper portion, which contacts the cathode support rail, makes a sliding electrical contact with the support rail. Thus, the required cathodic current is supplied to each cathode from the cathode support rail.

In the embodiment, the cathode support rail is fixed and the cathode supports engage with a conveyer system, or chain drive system, (not shown) to drive the cathode supports along the cathode support rail, in sliding contact with the rail, from the loading position to the unloading position.

In a preferred embodiment of the invention, the fused salt is a mixture of calcium chloride and calcium oxide at a temperature of about 900 C. The anodes are of carbon, and each anode is mounted in the anode assembly such that its vertical height can be adjusted, in order to control the spacing between each anode and the cathodes passing beneath it. The cathode trays are of a non-magnetic material, to avoid undesirable effects of magnetic fields, and are of a material which resists corrosion in the electro-reduction environment. Suitable materials include stainless steel and titanium. The cathode supports may be of a similar material to the cathodes but should additionally be insulated from the fused salt (at least where the cathode supports contact the fused salt) in order to avoid stray electrical currents. Thus, for example, the cathode supports may be sheathed in a ceramic sheath, for example of alumina or boron nitride.

As shown in FIG. 1, some or all of the cathodes may be provided with a scoop 40 extending below the cathode so as to be positioned in contact with or in close proximity to the base of the container. Such scoops may advantageously serve to dislodge any high-density contaminants from the base of the cell as the cathode is moved from the loading position to the unloading position.

As shown in the embodiment of FIG. 4, it may be desirable to increase the thermal insulation of the container by allowing a layer 42 of the fused salt to solidify, or freeze, on the side walls of the container. In that case, the cathode supports should be shaped so as to be positioned sufficiently far from the side wall to avoid contact with the frozen salt layer. The frozen salt layer may advantageously protect the wall of the container from corrosion as well as providing thermal insulation.

Figure 8:
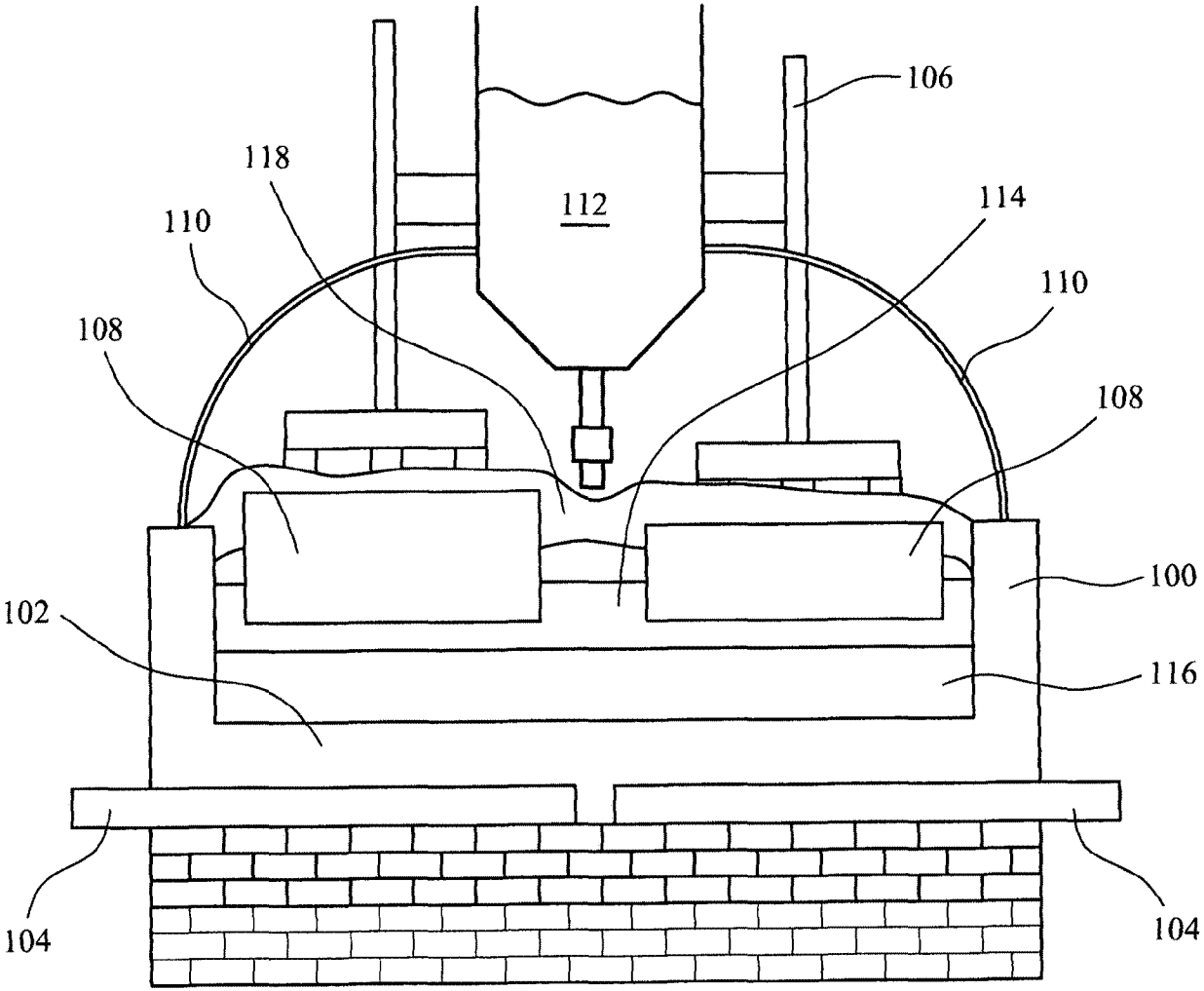
FIG. 8 is a transverse section of a conventional aluminium smelter cell.

FIG. 8 is a cross-section of a conventional aluminium production apparatus, or "pot", for implementing the Hall-Hèroult method. The apparatus comprises a container 100. The base 102 of the container is of carbon and forms the cathode, fed with electricity by collector bars 104. An anode assembly 106 supports an array of rectangular carbon anodes 108. The vertical height of each anode is adjustable. The container is covered by a pot cover 110 and an alumina bin 112 is positioned above the container for feeding additional alumina into the container as required.

During electrolysis, the container contains a layer of fused salt 114 (cryolite and alumina) in contact with the anodes and floating on top of a layer of molten aluminium 116. The aluminium is in contact with the carbon base of the container and acts as the cathode. Electrolysis of the alumina dissolved in the fused salt continuously produces aluminium metal, which can be tapped from the container in known manner.

During electrolysis, a crust 118 forms on top of the fused salt, which helps to thermally insulate the melt.

Figure 9:
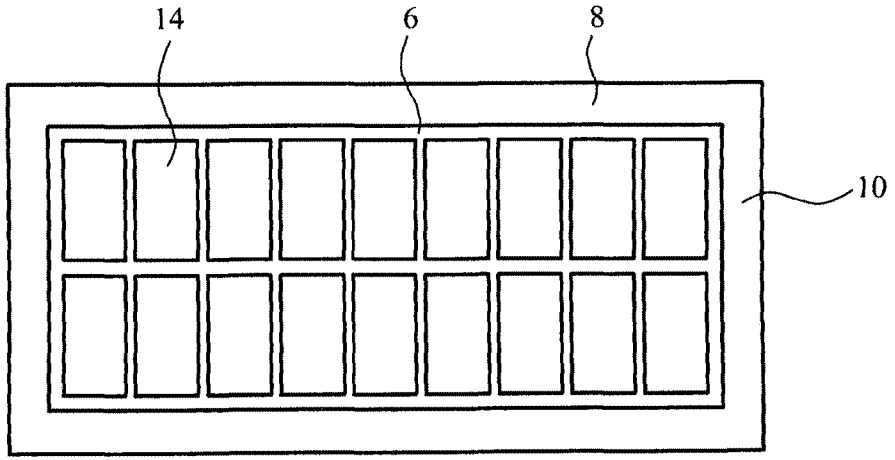
FIG. 9 is a plan view of the anode arrangement in a conventional aluminium smelter cell.

FIG. 9 shows a schematic plan view of the anodes of the aluminium cell of FIG. 8.

Figure 10:
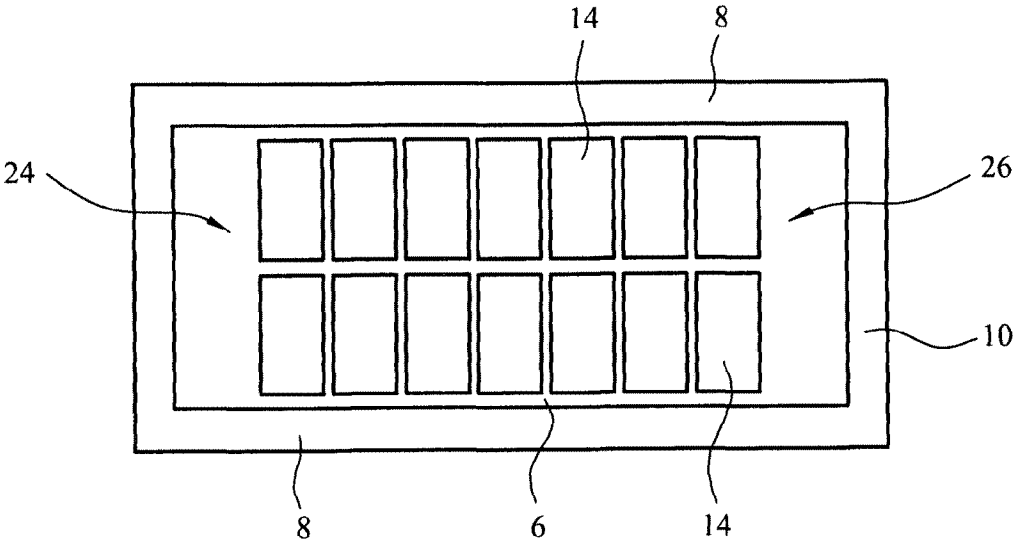
FIG. 10 is a plan view of the aluminium smelter cell of FIG. 9, with the end anodes removed.

In a preferred aspect, the present invention provides a method for modifying an existing aluminium cell, including cells of this type, for the electro-reduction of a solid feedstock. An aluminium cell does not require loading or unloading positions as described above in relation to FIGS. 1 to 5, and therefore the array of anodes covers the whole of the area of the cell as shown in FIG. 9. Anodes at the end of the aluminium cell may then be removed, as shown in FIG. 10, on converting the cell for reduction of a solid feedstock, so as to provide cathode loading and unloading positions 24, 26.

Figure 6:
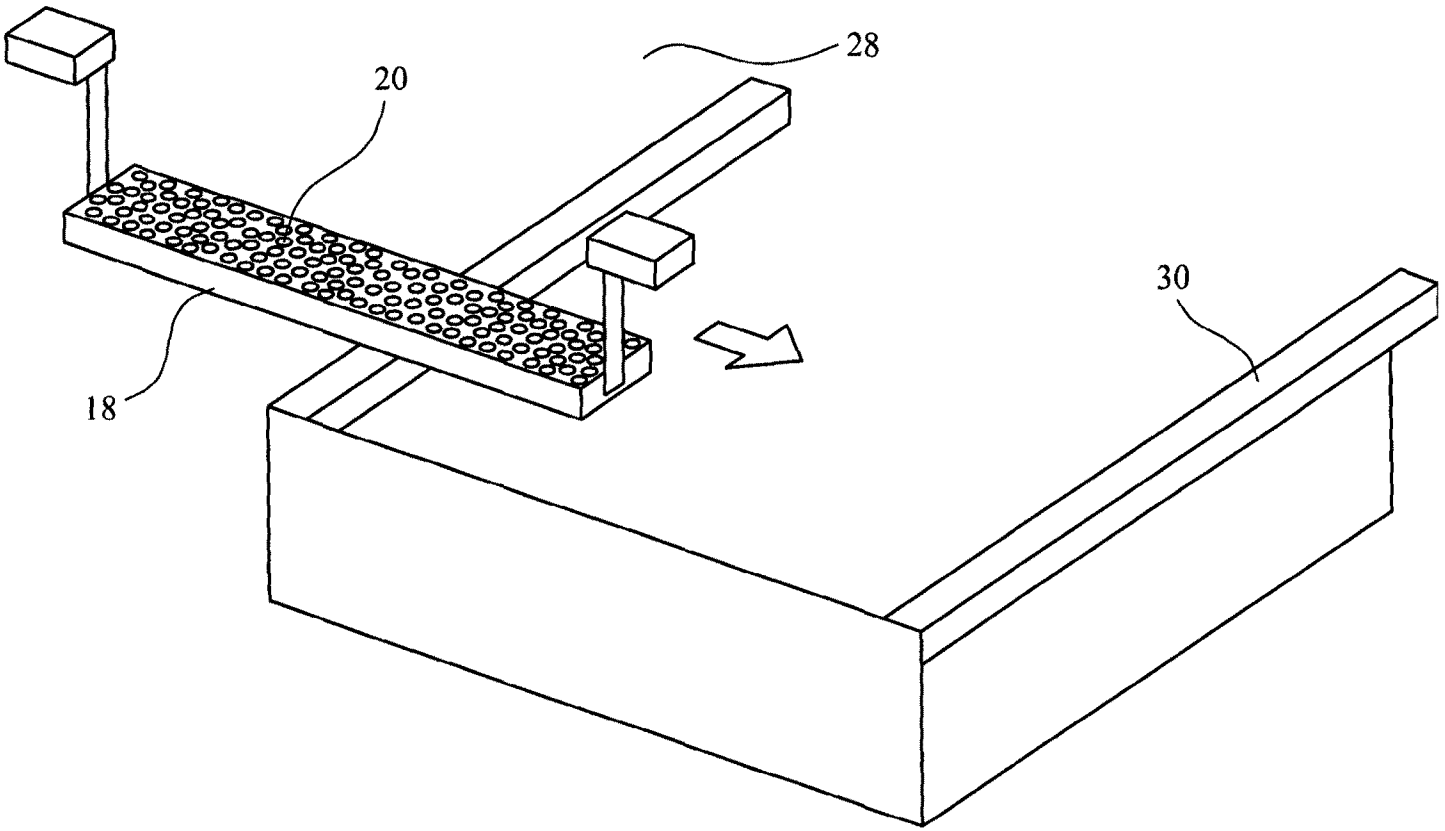
FIG. 6 is a three-quarter view of a cathode, loaded with feedstock.
Figure 7:
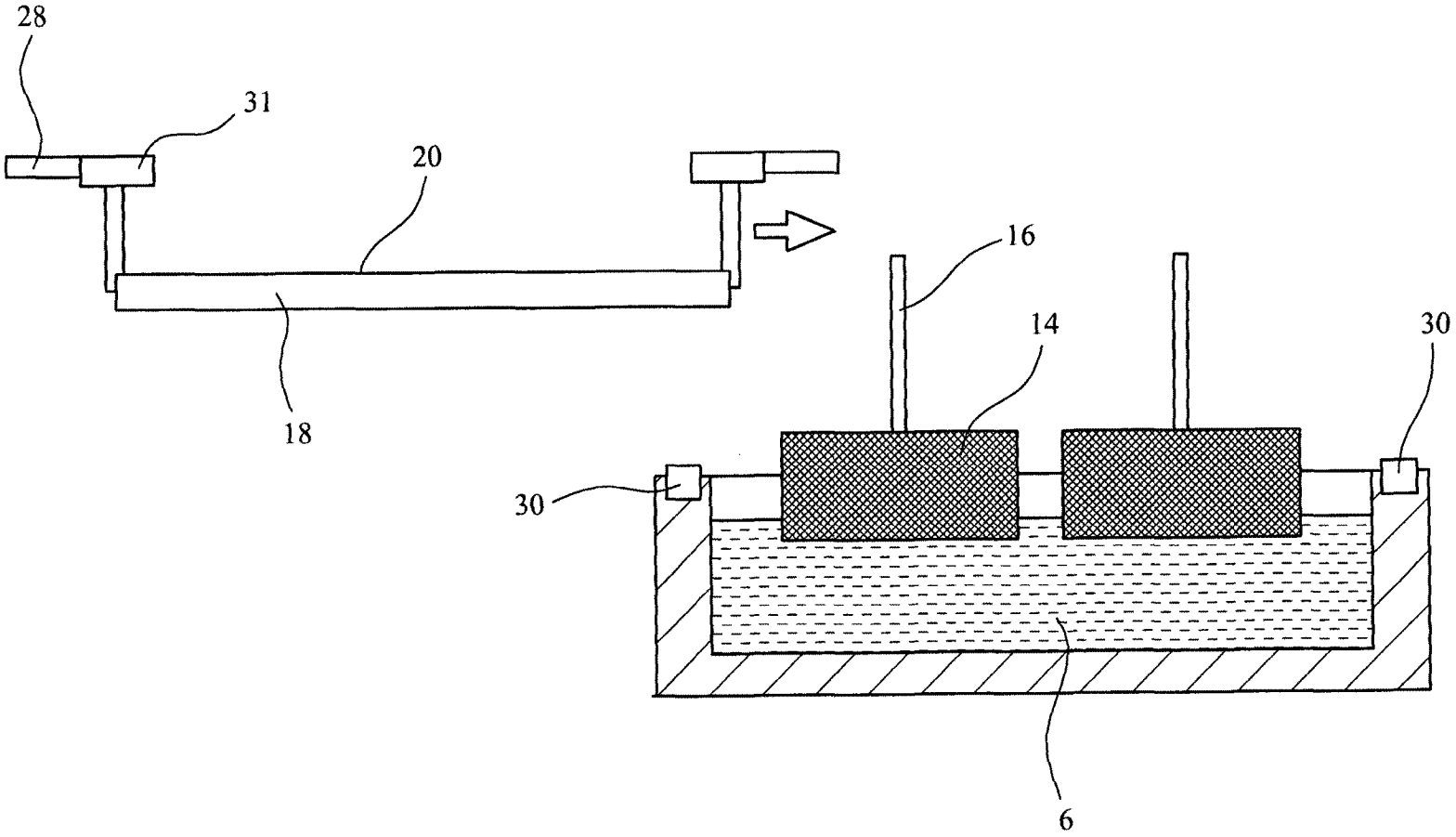
FIG. 7 is a schematic transverse section of an electro-reduction apparatus according to a third embodiment of the invention, illustrating side-loading of a cathode.
Figure 11:
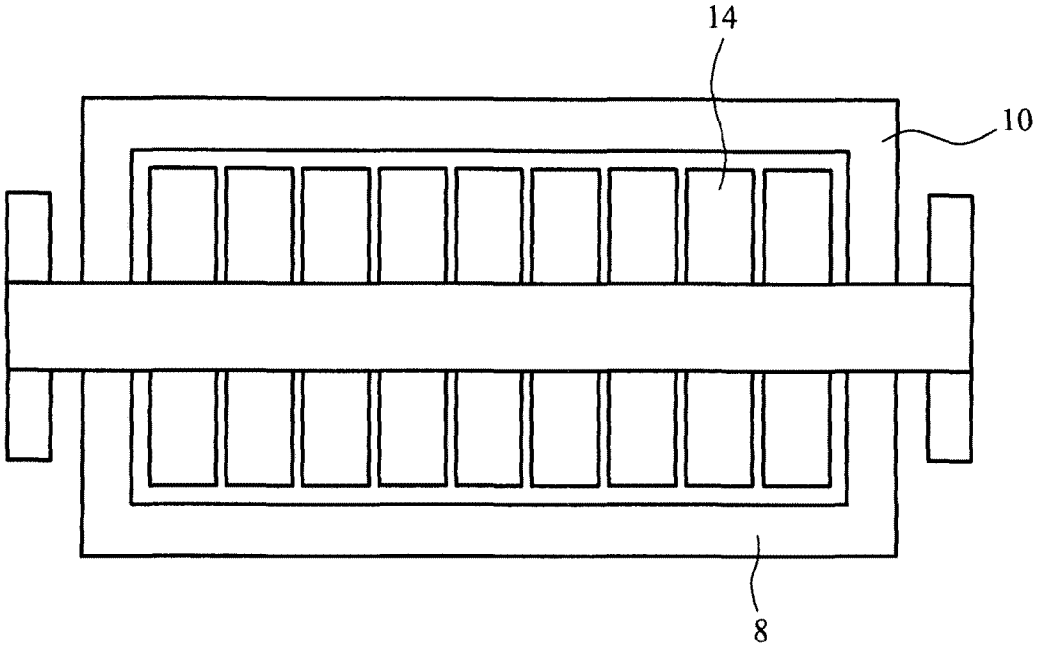
FIG. 11 is a plan view of an aluminium smelter cell showing a frame for supporting the anodes.

A further feature of the aluminium cell is that the anode assembly is typically supported as shown in the schematic plan view of FIG. 11 by a beam extending longitudinally above the central axis of the cell, supported at each end by a substantial A-frame. On converting an aluminium cell to a cell for continuous electro-reduction of a solid feedstock, it may be advantageous to retain the anode supporting frame and to load and unload the cathodes, carrying the solid feedstock and solid product, over the side wall of the cell as shown in FIGS. 6 and 7 (the loading direction is indicated by an arrow in each Figure). Once the cathode and cathode supports have passed over the side wall of the container and are in position above the loading position, they can be lowered until the cathode supports come into contact with the cathode support rails. Advantageously, in order to assist with loading and unloading, in particular over a side wall of the container, the cathode support rails should be positioned as low as possible, or in other words at a minimum elevation above the surface of the fused salt. Conveniently, as shown in FIG. 7, the cathode support rails may therefore be mounted on or recessed into the tops of the side walls of the container.

Figure 12:
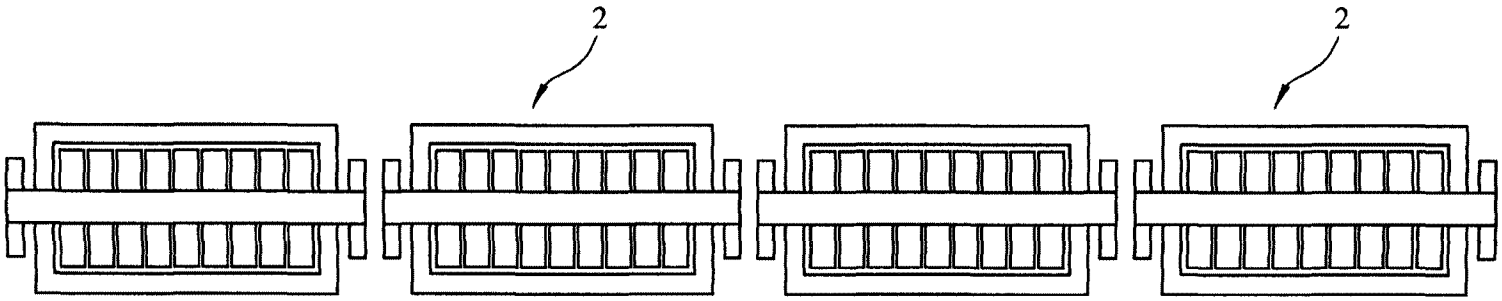
FIG. 12 is a plan view of an aluminium smelter pot-room, with cells arranged end-to-end.

A conventional aluminium production facility, or pot-room, typically comprises many individual electrolysis cells. In some cases, the cells are arranged in a row end-to-end, as shown in FIG. 12. The row of cells can then be converted to operation with a solid feedstock by removing the anodes at each end of each cell, as described above. The cathodes can then be loaded and unloaded over the side wall of each container.

Figure 13:
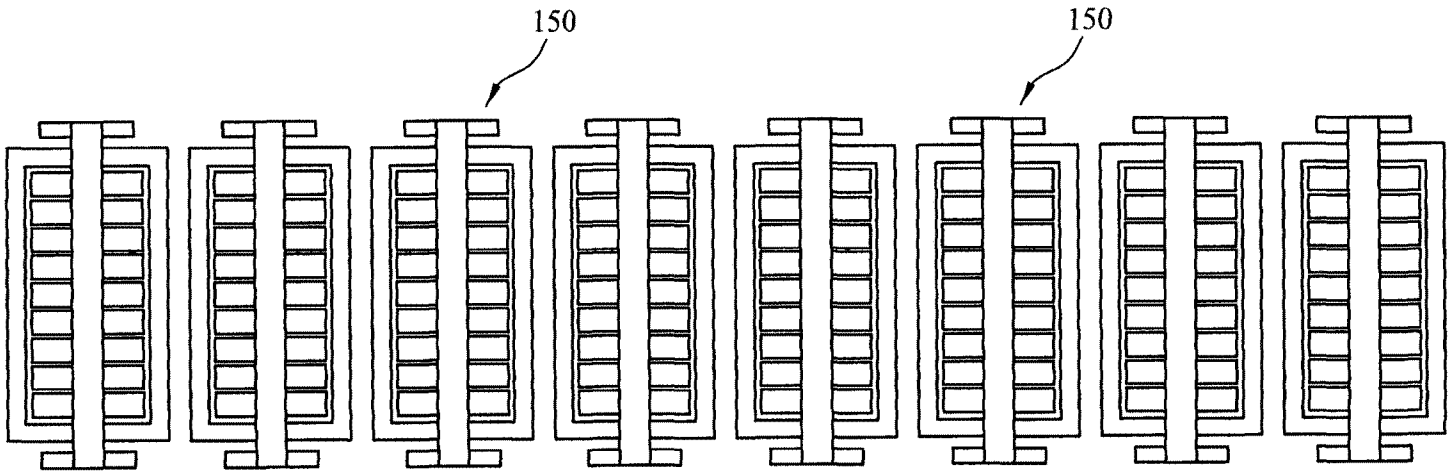
FIG. 13 is a plan view of an aluminium smelter pot-room with cells arranged side-by-side.
Figure 14:
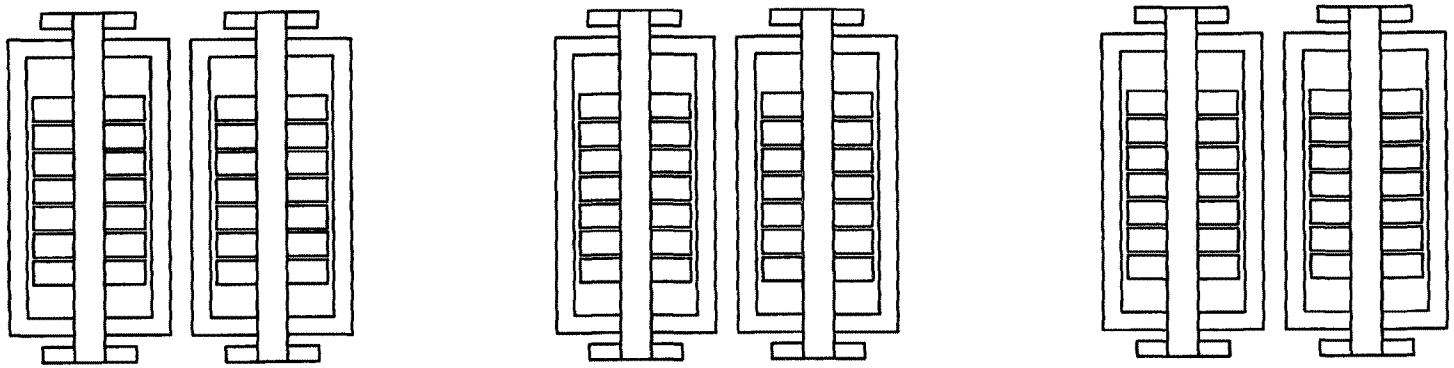
FIG. 14 is a plan view of the aluminium smelter pot-room of FIG. 13 modified for continuous solid-phase feedstock electro-reduction according to an embodiment of the invention.

In other cases, the aluminium cells in a pot-room are arranged side-by-side. Even if the anodes at each end of each cell are removed, there may then be no space to load and unload the cathodes for solid feedstock reduction. The A-frames at the ends of each aluminium cell for supporting the anode assembly may prevent loading the cathodes from the ends of the cells. In this case, to covert an aluminium pot-room for electro-reduction of solid feedstock, every third aluminium cell may be removed from the pot-room as shown in FIGS. 13 and 14. FIG. 13 shows an aluminium pot-room, from which two of the cells 150 need to be removed. In FIG. 14 these cells 150 have been removed, and the endmost anodes of the remaining cells removed, to allow side access to each cell for cathode loading and unloading.

In a cell for continuous electro-reduction of a solid feedstock, it may be desirable to maintain a substantially steady state for the electro-reduction reaction. In this way, the feedstock loaded onto each successive cathode may experience the same reduction conditions and produce product of the same quality.

We claim:

1. An apparatus for electrochemical reduction of a solid feedstock to form a solid product, comprising;

a container for a fused salt;

an anode assembly comprising one or more anodes assembled with an anode support in which, during operation of the apparatus, the one or more anodes contact the fused salt;

a cathode loadable with the solid feedstock at a feedstock loading station before immersion in the fused salt, the cathode comprising an electrically-conductive, horizontally-oriented tray for carrying the solid feedstock; and a cathode transport apparatus configured for locating and moving the cathode so that, in use, the cathode and the solid feedstock contact the fused salt;

the cathode transport apparatus configured for moving the cathode from a loading position to an unloading position, in which the loading position is spaced from the unloading position, the anode assembly being positioned between the loading position and the unloading position;

in which the cathode transport apparatus is configured to lower the cathode, carrying the solid feedstock, into the container and into the fused salt at the loading position, is also configured to then move the cathode past the anode assembly, below the anode assembly, and is also configured to then raise the cathode, carrying the solid product, out of the container and out of the fused salt at the unloading position;

the apparatus being couplable to a power supply for applying a potential between the one or more anodes and the cathode such that the solid feedstock loaded on the cathode is reduced to form the solid product as the cathode transport apparatus moves the cathode past the anode assembly.

2. The apparatus according to claim 1, in which the cathode transport apparatus raises the cathode out of the container at an unloading position into a vessel containing an inert atmosphere.

3. The apparatus according to claim 1, in which the container comprises a base and the cathode transport apparatus moves the cathode between the anode assembly and the base of the container, and in which optionally either the cathode or a cathode assembly comprising the cathode and a cathode support contacts the base of the container.

4. The apparatus according to claim 1, in which the anode assembly comprises an array of two or more carbon anodes which are spaced from each other in a horizontal direction.

5. The apparatus according to claim 1, in which the position of the anode or each anode is adjustable to control the spacing between the anode or each anode and the cathode.

6. The apparatus according to claim 1, in which the container comprises a side wall, and an opening is defined between the side wall and the anode assembly, and in which the cathode transport apparatus comprises a cathode support for supporting the cathode such that, when the cathode is positioned in the container for electrochemical reduction of the feedstock, the cathode support extends through the opening and an upper end of the cathode support extends out of the fused salt.

7. The apparatus according to claim 6, in which the side wall is one of two parallel side walls, and the opening is one of two openings, each defined between a respective one of the side walls and the anode assembly, and in which the cathode support is one of two cathode supports for supporting the cathode, each extending through a respective one of the openings during electrochemical reduction.

8. The apparatus according to claim 7, in which at least one of the cathode supports is electrically conductive, for the application of a cathodic potential to the cathode.

9. The apparatus according to claim 6, in which the cathode transport apparatus comprises a drive apparatus for engaging with the cathode support so as to move the cathode support along the opening between the side wall and the anode assembly, and to move the cathode past the anode assembly.

10. The apparatus according to claim 9, in which the drive apparatus comprises a cathode support rail extending along a side of the opening between the loading position and the unloading position, adjacent to the side wall, and in which the cathode support engages with the rail to locate the cathode in position.

11. The apparatus according to claim 10, in which the cathode support and the rail are electrically conductive and are in electrical contact with each other, and in which a cathodic potential is applied to the cathode by supplying a voltage to the electrically-conductive rail.

12. A method for electrochemical reduction of a solid feedstock, comprising the steps of;

providing an apparatus of claim 1;

loading the cathode with a solid feedstock; and moving the cathode past the anode assembly while passing a current between the cathode and the one or more anodes so as to reduce the feedstock.

13. A method for converting an aluminium production cell that uses the Hall-Héroult process into a cell for reduction of a solid feedstock by electrolysis in a fused salt that uses an apparatus of claim 1, comprising the steps of removing anodes adjacent to each end of the cell in order to allow space for a loading position for loading into the cell cathodes carrying the solid feedstock, and an unloading position for removing cathodes carrying reduced feedstock, and installing a cathode transport apparatus for moving the cathodes from the loading position to the unloading position past the remaining anodes of the cell.

14. The apparatus according to claim 11, wherein the cathode support and its respective rail are in electrical contact with each other by means of a sliding contact.

15. The apparatus according to claim 6, in which the cathode support is electrically conductive, for the application of a cathodic potential to the cathode.

16. The apparatus according to claim 1, in which the cathode is inert in the presence of the feedstock, the product and the fused salt.

17. The apparatus according to claim 7, in which the cathode transport apparatus comprises a drive apparatus for engaging with the cathode supports so as to move the cathode supports along the openings between the side walls and the anode assembly, and to move the cathode past the anode assembly.

18. The apparatus according to claim 17, in which the drive apparatus comprises a cathode support rail extending along a side of each opening between the loading position and the unloading position, adjacent to the respective side wall beside each opening, and in which each cathode support engages with a respective rail to locate the cathode in position.

19. The apparatus according to claim 18, in which at least one of the cathode supports and its respective rail are electrically conductive and are in electrical contact with each other, and in which a cathodic potential is applied to the cathode by supplying a voltage to the electrically-conductive rail.

20. The apparatus according to claim 19, wherein at least one of the cathode supports and its respective rail are in electrical contact with each other by means of a sliding contact.

21. The apparatus according to claim 6, in which the cathode transport apparatus comprises a drive apparatus for engaging with the cathode support so as to move the cathode support along the opening between the side wall and the anode assembly, and to move the cathode past the anode assembly from the loading position to the unloading position.

22. The apparatus according to claim 7, in which the cathode transport apparatus comprises a drive apparatus for engaging with the cathode supports so as to move the cathode supports along the openings between the side walls and the anode assembly, and to move the cathode past the anode assembly from the loading position to the unloading position.

* * * * *